US010677107B2

(12) United States Patent
Blackmur et al.

(10) Patent No.: US 10,677,107 B2
(45) Date of Patent: Jun. 9, 2020

(54) ROLLER FORMED HYDRAULIC VARIABLE CAM TIMING PHASER

(71) Applicant: BorgWarner Inc., Auburn Hills, MI (US)

(72) Inventors: Shawn J Blackmur, Brooktondale, NY (US); Chad McCloy, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/708,563

(22) Filed: Sep. 19, 2017

(65) Prior Publication Data

US 2018/0080351 A1 Mar. 22, 2018

Related U.S. Application Data

(60) Provisional application No. 62/398,237, filed on Sep. 22, 2016.

(51) Int. Cl.
*F01L 1/34* (2006.01)
*F01L 1/344* (2006.01)

(52) U.S. Cl.
CPC ..... *F01L 1/34* (2013.01); *F01L 1/344* (2013.01); *F01L 1/3442* (2013.01); *F01L 2103/00* (2013.01)

(58) Field of Classification Search
CPC . F01L 1/34; F01L 1/3442; F01L 1/344; F01L 2103/00
USPC ..... 123/90.17, 90.15
See application file for complete search history.

(56) References Cited

U.S. PATENT DOCUMENTS

| | | | | |
|---|---|---|---|---|
| 3,395,441 | A | 8/1968 | Herbenar | |
| 7,314,031 | B2 | 1/2008 | Le Troadec et al. | |
| 7,421,989 | B2 | 9/2008 | Fischer et al. | |
| 9,297,449 | B2 | 3/2016 | Taniguchi et al. | |
| 9,581,054 | B2 | 2/2017 | Bayrakdar et al. | |
| 2010/0236050 | A1 | 9/2010 | Himbert et al. | |
| 2011/0030632 | A1* | 2/2011 | David | F01L 1/344 123/90.17 |

* cited by examiner

*Primary Examiner* — Patrick Hamo
*Assistant Examiner* — Wesley G Harris
(74) *Attorney, Agent, or Firm* — Brown & Michaels, PC

(57) ABSTRACT

Roller forming portions of the VCT phaser to join the sprocket housing of the phaser to the end plates provides a reduction in oil leakage from the phaser as well as less distortion of the end plates of the phaser. Furthermore, by roller forming the sprocket housing of the VCT phaser to secure the end plates to the sprocket housing, the total number of parts needed is reduced, and the total number of holes needed to be drilled is reduced, reducing the overall cost of the phaser.

8 Claims, 7 Drawing Sheets

ROLLER FORMED HYDRAULIC VARIABLE CAM TIMING PHASER

CROSS-REFERENCE TO RELATED APPLICATIONS

This application claims the benefit of U.S. patent application Ser. No. 62/398,237 filed on Sep. 22, 2016, the disclosure of which is herein incorporated by reference in its entirety.

BACKGROUND OF THE INVENTION

Field of the Invention

The invention pertains to the field of roller forming. More particularly, the invention pertains to roller forming a portion of the hydraulic variable cam timing (VCT) phaser or an electric phaser (e-phaser).

SUMMARY

Roller forming portions of the VCT phaser to join the sprocket housing of the phaser to the end plates provides a reduction in oil leakage from the phaser as well as less distortion of the end plates of the phaser. Furthermore, by roller forming the sprocket housing of the VCT phaser to secure the end plates to the sprocket housing, the total number of parts needed is reduced, and the number of holes needed to be drilled is reduced, reducing the overall cost of the phaser. Additionally, the overall package is reduced since a snap ring is not needed and the process of joining the sprocket housing of the phaser to the end plates by roller forming or orbital riveting replaces at least one weld, which can cause distortion.

DETAILED DESCRIPTION

Figure 1:
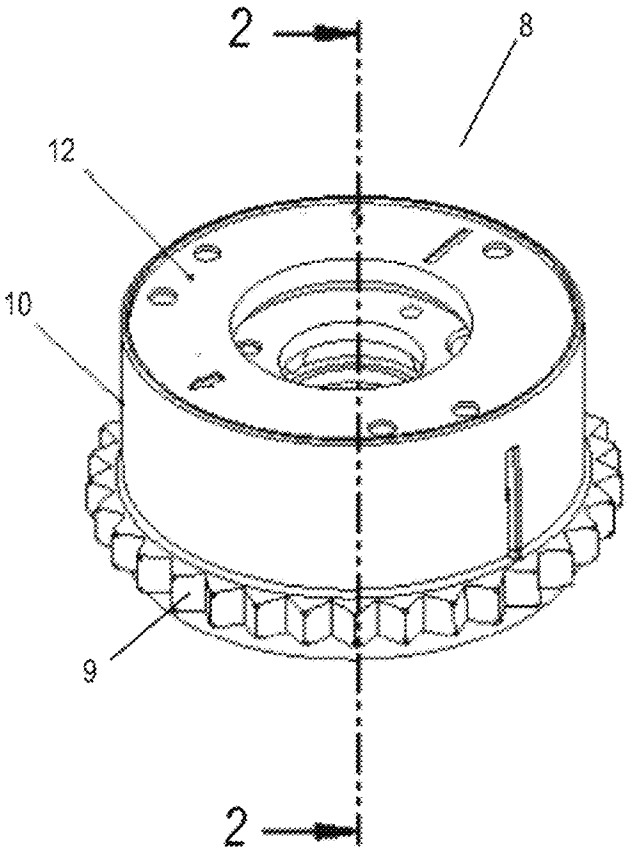
FIG. 1 shows perspective view of a phaser prior to roller forming.
Figure 2:
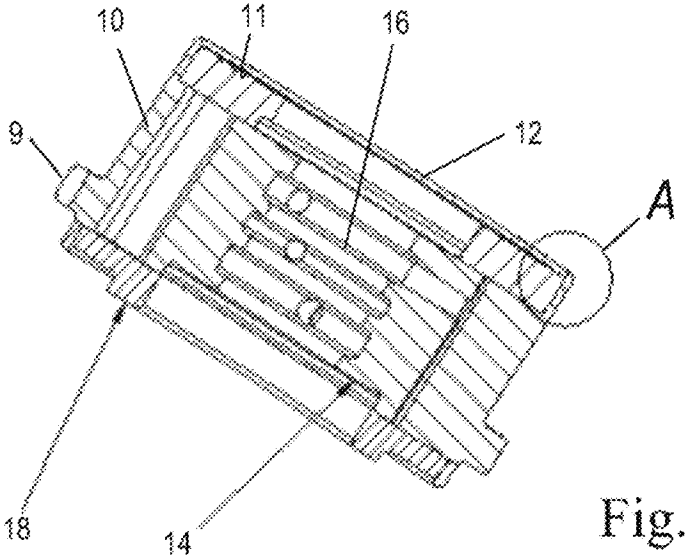
FIG. 2 shows a sectional view of FIG. 1 along line 2-2.
Figure 3:
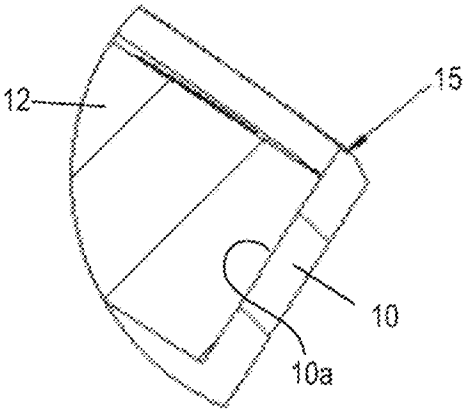
FIG. 3 shows a detail of area A of FIG. 2 prior to roller forming.
Figure 5:
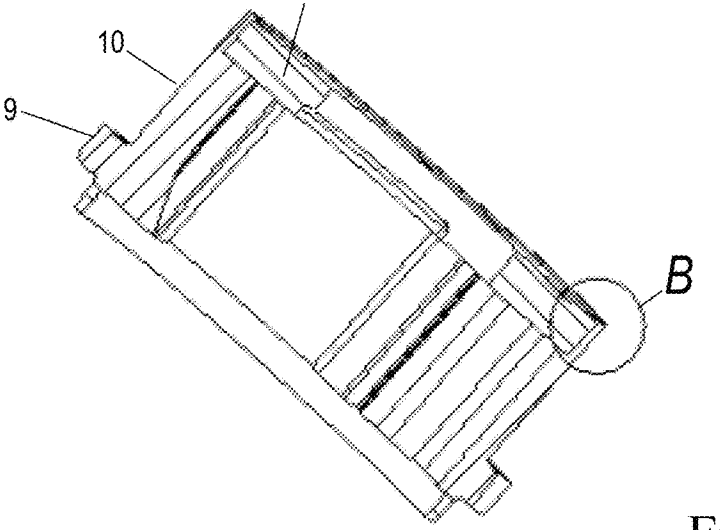
FIG. 5 shows a sectional view of FIG. 4 along line 5-5.
Figure 6:
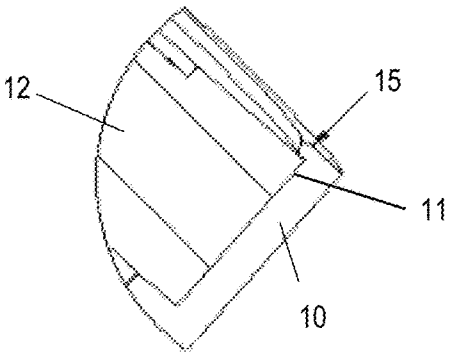
FIG. 6 shows a detail of area B of FIG. 5.
Figure 4:
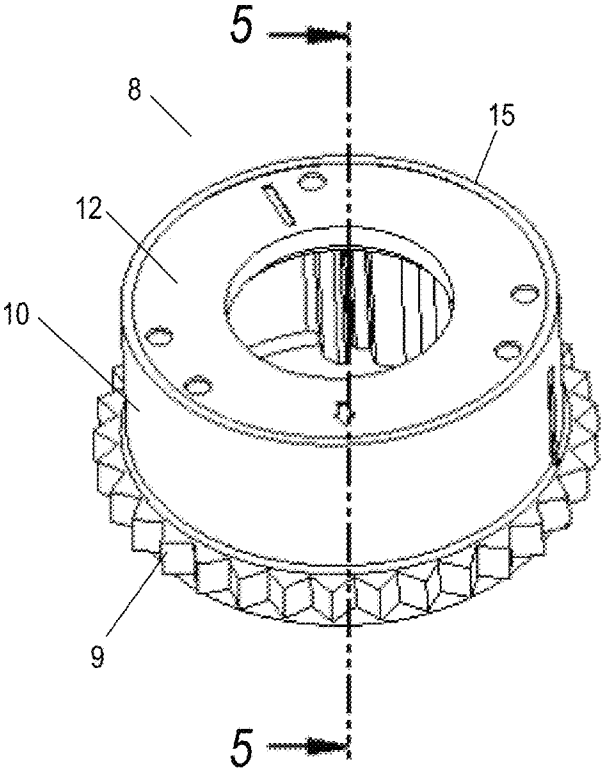
FIG. 4 shows a perspective view of the phaser after roller forming.

FIGS. 1-6 show a phaser prior to and after roller forming the sprocket housing 10 to secure the end plates 12, 18 to the sprocket housing of the VCT phaser 8. The VCT phaser 8 may be a hydraulic phaser or an electric phaser. It should be noted that the rotor 14 and the oil control valve 16 of the phaser 8 are present in FIGS. 1-3, but have been removed from FIGS. 4-6 for clarity purposes. While FIGS. 4-6 show only one of the end plates 12 being captured by roller forming, the process would be repeated on the other side of the sprocket housing. In preferred embodiments, both sides of the sprocket housing 10 are roller formed to complete the assembly of the phaser 8.

The sprocket housing 10 has sprocket teeth 9 around an outer circumference thereof. The housing also has counterbores 11, 13 on either side of the sprocket housing 10. The counterbores 11, 13 of the housing 10 receive end plates 12, 18. The counterbores 11, 13 are preferably an internal step cut into the internal diameter 10*a* of the sprocket housing 10. The counterbores 11, 13 do not interfere with the rotor 14 or oil control valve 16. The end plates 12, 18 may be pressed into the counterbores 11, 13 until the end plates 12, 18 are flush with the counterbore 11, 13.

When the end plates 12, 18 are present in the counterbores 11, 13 of the sprocket housing 10, prior to roller forming, the edges on each side of the sprocket housing 10 form a lip or flange 15 which axially extends further than the end plates 12, 18 as shown in FIGS. 2 and 3.

The lip or flange 15 of the sprocket housing 10 undergoes continuous bend (roller forming) until the lip 15 captures the recessed end plate 12, 18, retaining the end plates 12, 18 to the housing 10 as shown in FIGS. 5-6.

By retaining the end plates 12, 18 to the sprocket housing 10 through roller forming, the amount of end plate 12, 18 distortion is lowered and the oil leakage from the phaser 8 where the end plates are joined to the sprocket housing 10 is reduced. Additionally, the holes, tapped holes, and bolts needed to ordinarily fasten the end plates to the sprocket housing are eliminated. The overall package of the phaser is smaller also. Welding of the end plates 12, 18 to the sprocket housing 10 can also be eliminated. Furthermore, the end plates 12, 18 may be thinner and lighter.

Figure 7:
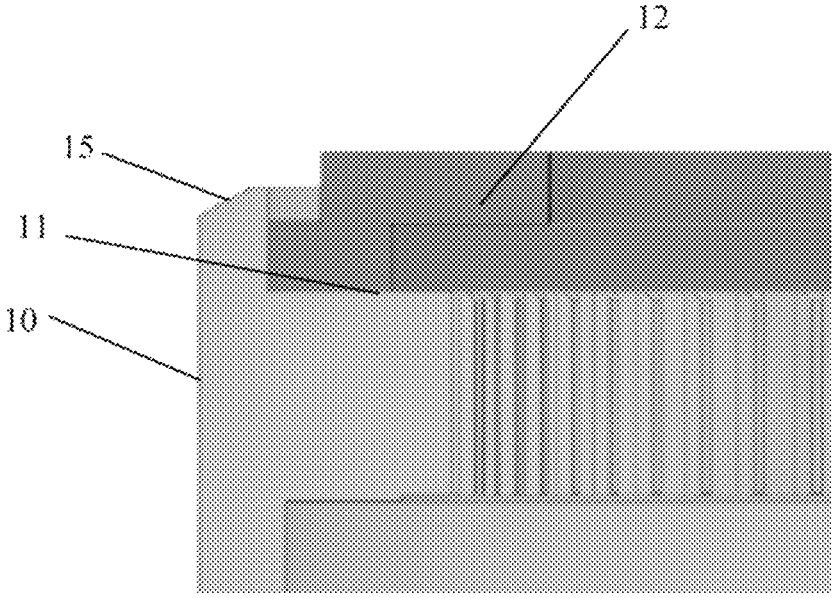
FIG. 7 shows a close up of an example of possible geometry of the end plate and the sprocket housing prior to roller forming.
Figure 8:
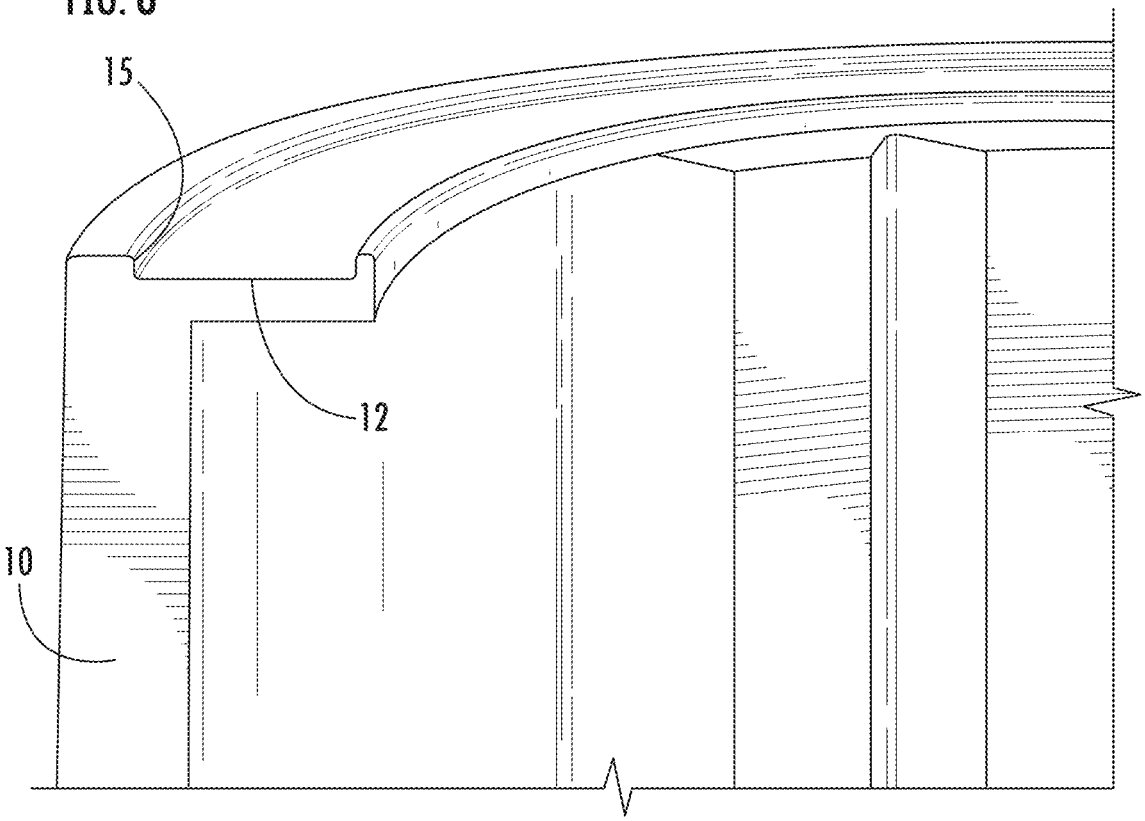
FIG. 8 shows a close up of the same example of possible geometry of the end plate and the sprocket housing of FIG. 7 after roller forming.

FIGS. 7-8 show a close up of an example of possible geometry of the end plate and the sprocket housing prior to roller forming and after roller forming has taken place, respectively.

FIGS. 9-17 show a schematic of an alternate embodiment of securing the end plates 112, 118 to the sprocket housing 110 via orbital riveting, with FIGS. 9-13 showing the phaser 108 prior to orbital riveting and FIGS. 14-17 showing the phaser 108 after orbital riveting. The phaser 108 may be a hydraulic phaser or an electric phaser.

Figure 10:
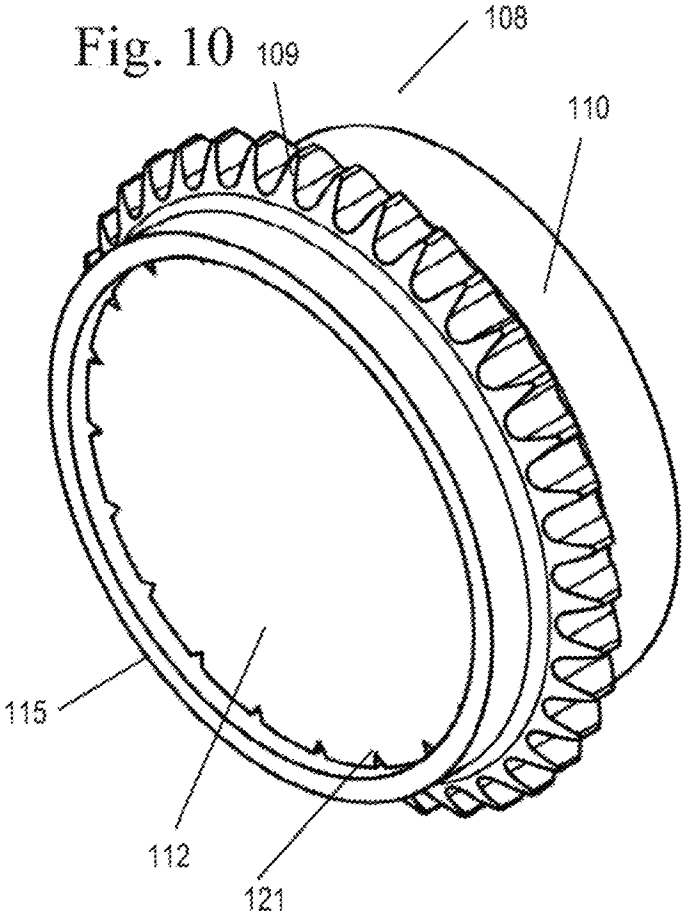
FIG. 10 shows a perspective view of the sprocket housing with an end plate pre-roll forming.
Figure 9:
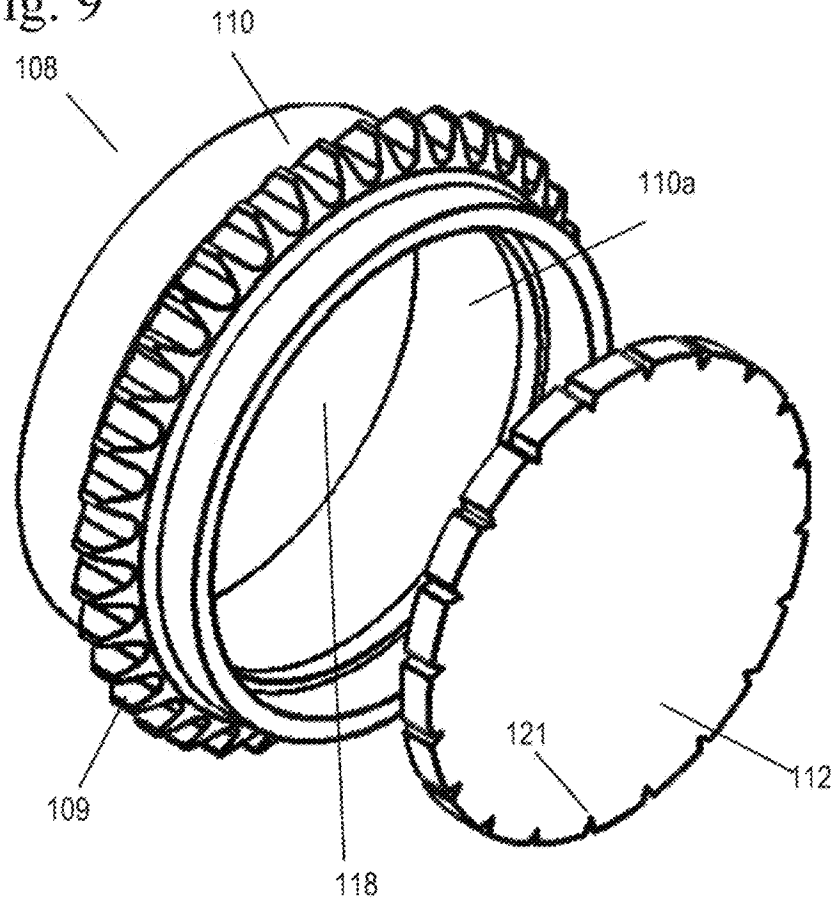
FIG. 9 shows an exploded perspective view of the sprocket housing and an end plate pre-roll forming.

It should be noted that the rotor 114 and the oil control valve 116 of the phaser 108 are not present in the drawings for clarity purposes. In addition, while FIGS. 9-10 show one of the end plates 112 being captured by roller forming, the process would be repeated on the other side of the sprocket housing. The end plates 112, 118 and counterbore 111, 113 for the other side of the sprocket housing have references numbers but are not shown in the Figures. In preferred embodiments, both sides of the sprocket housing are roller formed to complete the assembly of the phaser 108.

The sprocket housing 110 has sprocket teeth 109 around an outer circumference thereof. The housing also has counterbores 111, 113 on either side of the sprocket housing 110. The counterbore is an internal step 111, 113 cut into the sprocket housing 110. The counterbores 111, 113 of the sprocket housing 110 receive end plates 112, 118. The counterbores 111, 113 do not interfere with the rotor 114 or the oil control valve 116. It should be noted that the internal diameter 110*a* of the sprocket housing 110 is smooth prior to forming.

Figure 13:
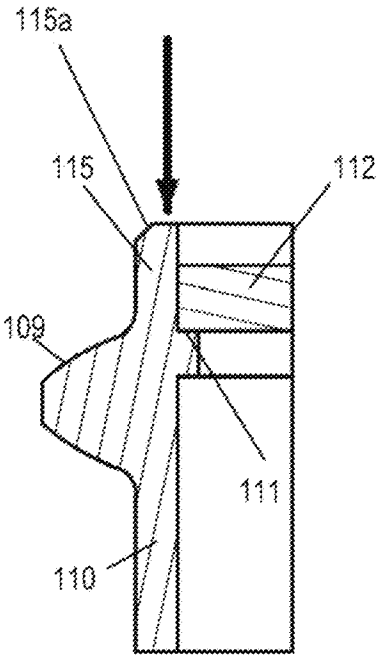
FIG. 13 shows a cross-section along line 12-13 prior to roller forming.
Figure 12:
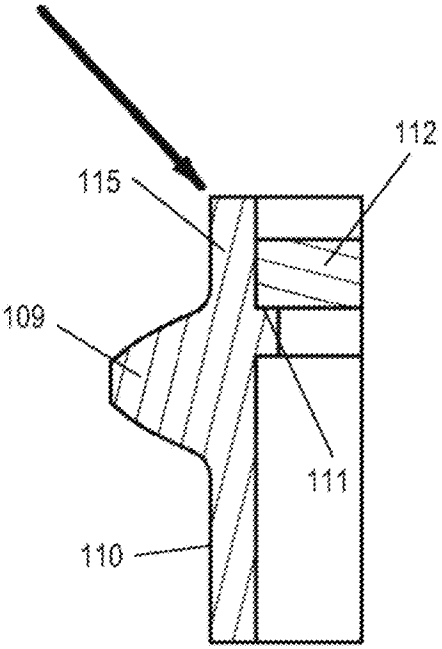
FIG. 12 shows a cross-section along line 12-13 prior to orbital riveting taking place.
Figure 11:
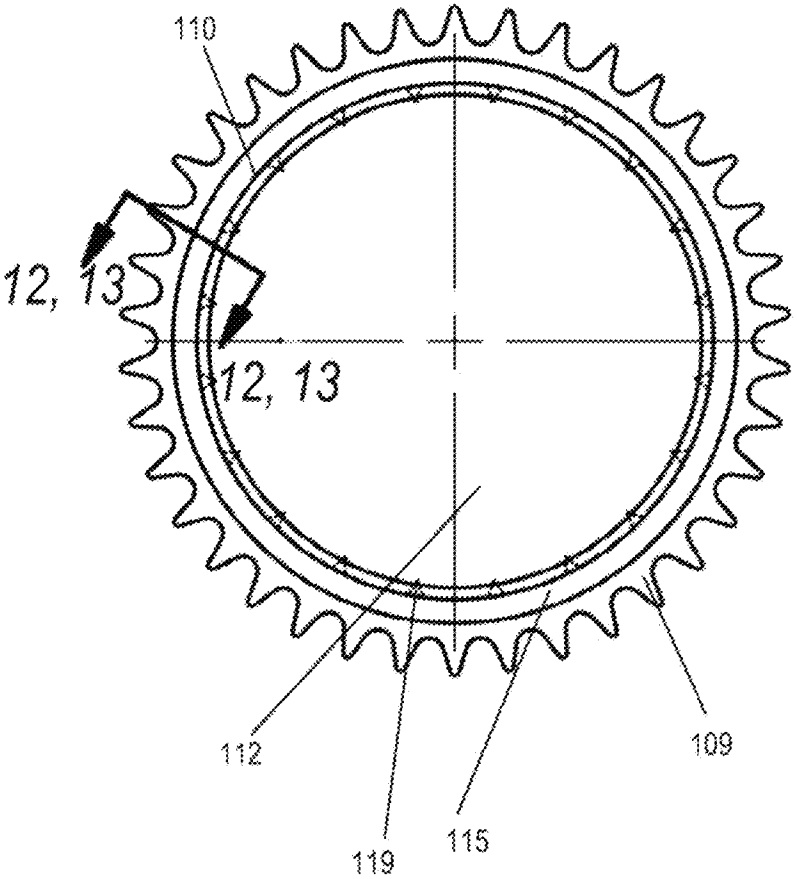
FIG. 11 shows a front view of the sprocket housing and end plate pre-roll forming.

FIG. 12 shows a cross-section of the sprocket housing and end plate prior to orbital riveting and roll forming. The arrow indicates the line of action of the forming tool. FIG. 13 shows a cross-section of the sprocket housing and end plate prior to roll forming. Because the roll forming tool only applies force vertically, the sprocket edge 115*a* is preferably chamfered to influence displaced material over the cover plate 112. When the end plates 112, 118 are present in the counterbores 111, 113 of the housing 110, prior to orbital riveting, the edges on each side of the sprocket housing 110 each form a lip or flange 115 which axially extends further than the end plates 112, 118 when seated within the counterbores 111, 113. The end plates 112, 118 contain cutouts or grooves 121 along an outer circumference which receive the flow riveting material, such as peen, during the riveting process. The cutouts or grooves 121 are preferably V-shaped.

An orbital riveting machine (not shown) may then use a peen which is gradually lowered onto the lip 115 of the housing, spreading the material of the rivet, such that the material flows into the grooves 121 along the outer circumference of the end plates 112, 118, creating projections 119 which complement the cutouts or grooves 121 of the end plates 112, 118, such that a mechanical joint 120 is created between the outer circumference of the end plates 112, 118 and the inner circumference 110*a* of the sprocket housing 110. The mechanical joint additional includes the lip 115 capturing the recessed end plates 112, 118 through the bending of the lip 115, retaining the end plates 112, 118 to the sprocket housing 110 as shown in FIGS. 14-19.

Figure 15:
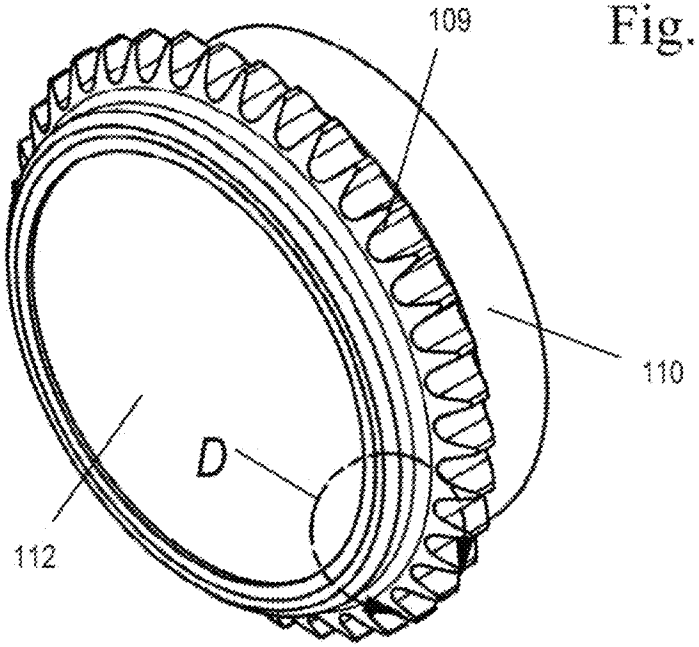
FIG. 15 shows a detailed close up of area C of FIG. 14.
Figure 14:
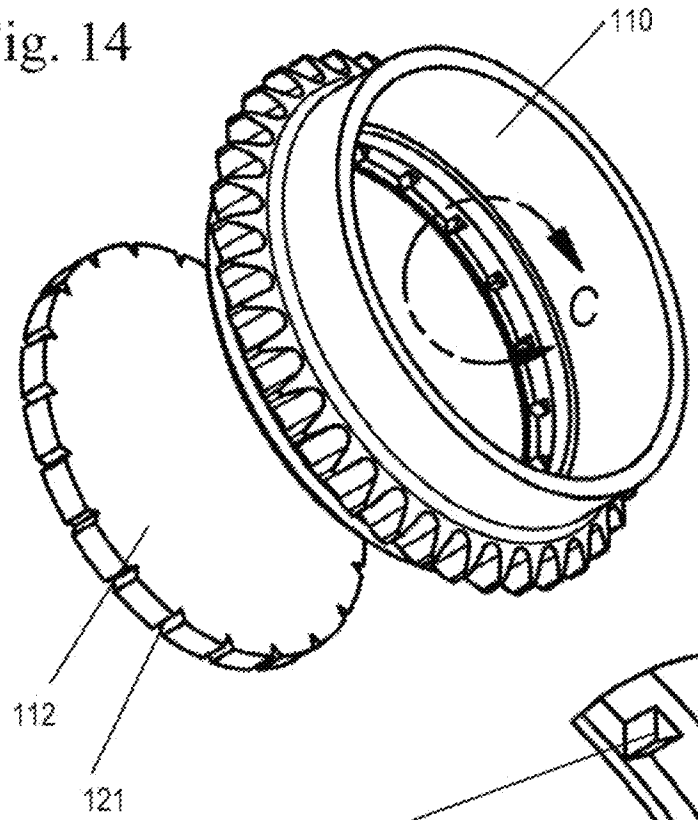
FIG. 14 shows an exploded perspective view of the sprocket housing and an end plate post-roll forming
Figure 16:
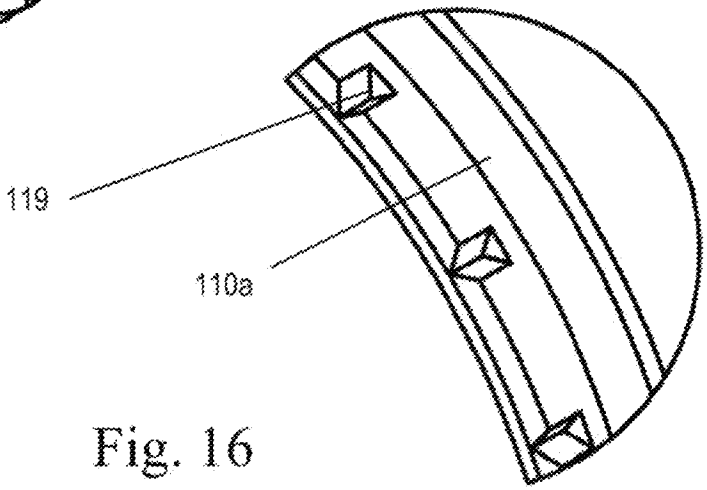
FIG. 16 shows a perspective view of the sprocket housing with an end plate post-roll forming.
Figure 18:
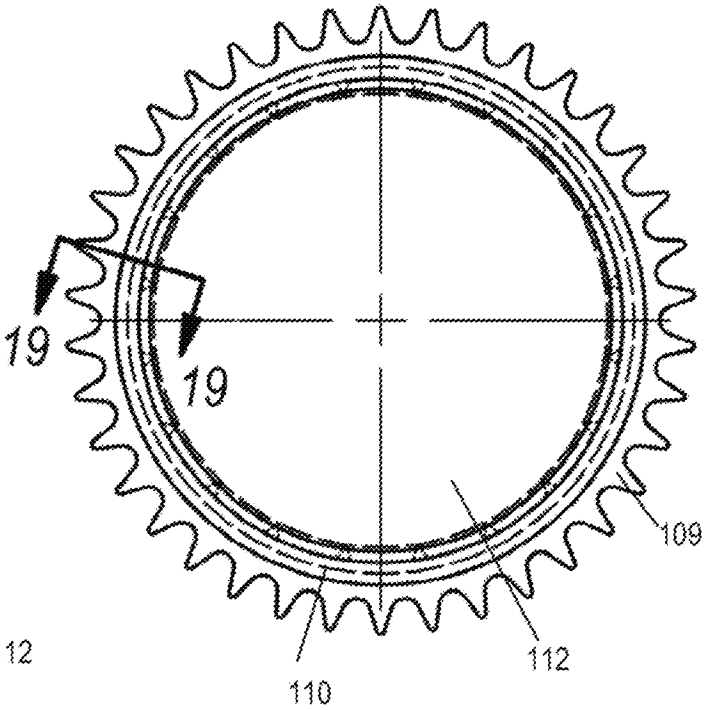
FIG. 18 shows a front view of the sprocket housing and end plate post-roll forming.
Figure 19:
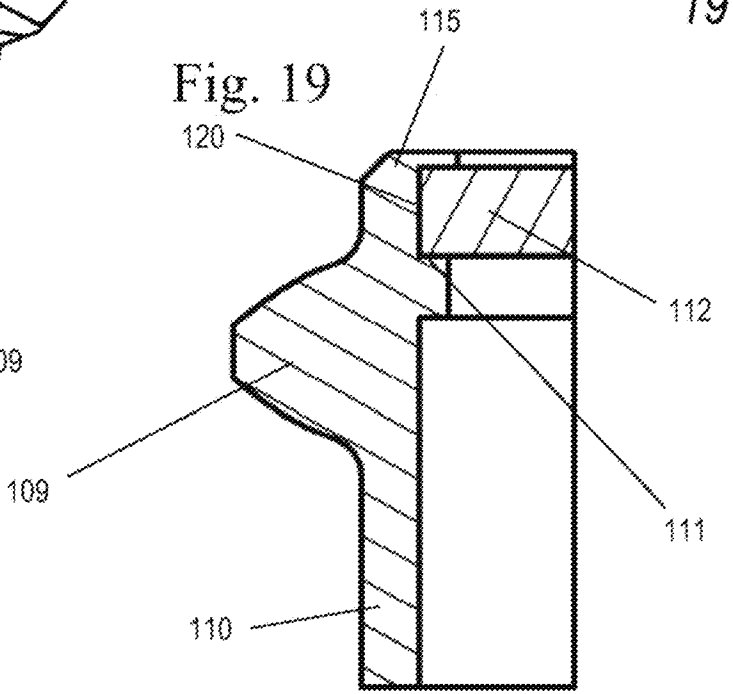
FIG. 19 shows a cross-section along line 19-19 of FIG. 18.
Figure 17:
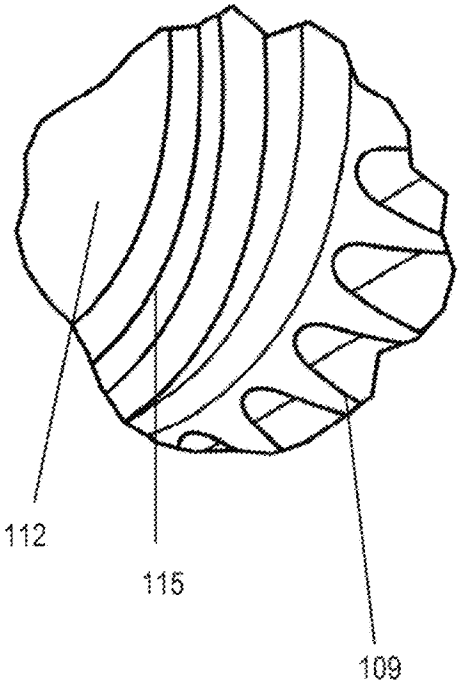
FIG. 17 shows a detailed close up of area D of FIG. 16.

FIG. 15 shows the V-grooves 121 in outer circumference of the end plate 112 which act like a press die forcing the rolled edge of the flange 115 and the peen into a triangular shape (projection 119), restricting the end plates ability to rotate. The projections 119 are formed on the inner diameter 110*a* of the sprocket housing 110 which was smooth prior to the forming taking place as shown in FIG. 9. The rolling die and the orbital riveting tool (not shown) acts on the flange 115 to force material forward over the end plates 112, 118 forming a captive lip 115 as seen in FIGS. 16-19.

The joint 120 formed between the end plate 112, 118 and the housing 110 has an increased torque carrying capability as compared to joints formed by a fastening means such as a bolt or screw.

In another embodiment, the roller forming of FIGS. 1-8 may be enhanced by forming grooves in the end plates and using the material and orbital riveting to further enhance the joint formed for torque transfer.

In an alternate embodiment, orbital riveting as described above may be used to attached an end plate on one side of the housing and roller forming as describe above may be used to attach an end plate to the other side of the housing.

In another embodiment, orbital riveting as described above may be used to attach an end plate to one side of the housing and conventional bolts may be used to attach an end plate to the other side.

In another embodiment, roller forming as described above may be used to attach an end plate to one side of the housing and conventional bolts may be used to attach an end plate to the other side.

In another embodiment, orbital riveting and roller forming as described above may be used to attach other components to the housing or the end plates of the phaser, such as attaching a pulley or a sprocket, the end plates may then be bolted to the phaser.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of retaining a first end plate to a first side of a sprocket housing of a variable cam timing phaser and a second end plate to a second side of the sprocket housing of the variable cam timing phaser, the method comprising:

press-fitting at least the first end plate of the sprocket housing of the variable cam timing phaser into a first counterbore formed as an internal step cut into an internal diameter of the sprocket housing of the variable cam timing phaser defined by at least the first side of the sprocket housing such that a portion of the sprocket housing on the first side axially extends past the first end plate to form a first lip;

applying peen to grooves defined on the first end plate such that the peen joins the first end plate to the first lip, creating a mechanical joint between the first lip and the first end plate; and continuously bending the first lip such that the first lip bends radially over the first end plate, adjacent to and parallel to the first end plate on the first counterbore and captures the first end plate on the first side of the sprocket housing.

2. The method of claim 1, further comprising: press-fitting the second end plate into a second counterbore formed as an internal step cut into the internal diameter of the sprocket housing defined by the second side of the sprocket housing, such that a portion of the sprocket housing on the second side of the sprocket housing axially extends past the second end plate to form a second lip; and continuously bending the second lip such that the second lip bends radially over the second end plate, adjacent to and parallel to the second end plate on the second counterbore and captures the second end plate on the second side of the sprocket housing.

3. The method of claim 2, further comprising: defining grooves on the second end plate and applying peen to the grooves on the second end plate such that the peen additionally joins the second end plate to the second lip, creating a mechanical joint between the second lip and the second end plate; and continuously bending the second lip such that the second lip bends and captures the second end plate on the second side of the sprocket housing.

4. The method of claim 1, wherein the continuous bending is carried out by roller forming.

5. A method of retaining a first end plate to a first side of a sprocket housing of a variable cam timing phaser and a second end plate to a second side of the sprocket housing of the variable cam timing phaser comprising the steps of:

press-fitting at least the first end plate of the variable cam timing phaser into a counterbore defined by at least the first side of the sprocket housing such that a portion of the sprocket housing on the first side axially extends past the first end plate to form a first lip;

applying peen to grooves on the first end plate such that the peen joins the first end plate to the first lip, creating a mechanical joint between the first lip and the first end plate; and continuously bending the first lip such that the first lip bends and captures the first end plate on the first side of the sprocket housing.

6. The method of claim 5, further comprising defining grooves on the second end plate.

7. The method of claim 6, further comprising: applying peen to the grooves on the second end plate such that the peen joins the second end plate to a second lip defined by a portion of the sprocket housing on the second side axially extending past the second end plate, creating a mechanical joint between the second lip and the second end plate; and continuously bending the second lip such that the second lip bends and captures the second end plate on the second side of the sprocket housing.

8. The method of claim 5, wherein the continuous bending is carried out by roller forming.

* * * * *